US006189624B1

(12) United States Patent
James

(10) Patent No.: US 6,189,624 B1
(45) **Date of Patent: *Feb. 20, 2001**

(54) ACTUATING MECHANISM FOR FIRE EXTINGUISHER

(75) Inventor: Robert Wilton James, Crafers (AU)

(73) Assignee: FF Seeley Nominees Pty. Ltd. (AU)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/149,392

(22) Filed: Sep. 8, 1998

(30) Foreign Application Priority Data

Sep. 9, 1997 (AU) ..... PO 9068

(51) Int. Cl.[7] ..... A62C 37/10
(52) U.S. Cl. ..... 169/61; 169/9; 169/85
(58) Field of Search ..... 169/56, 60, 61, 169/9, 33, 85; 239/309

(56) References Cited

U.S. PATENT DOCUMENTS

| | | | | |
|---|---|---|---|---|
| 2,713,391 | | 7/1955 | Buckholtz . | |
| 3,825,766 | * | 7/1974 | Connor et al. | 169/61 X |
| 3,986,560 | * | 10/1976 | Heath et al. | 169/61 |
| 4,263,971 | | 4/1981 | Spector et al. . | |
| 4,282,931 | * | 8/1981 | Golben | 169/61 |
| 4,637,473 | | 1/1987 | Gillis et al. . | |
| 4,760,886 | | 8/1988 | Sassier . | |
| 5,038,866 | * | 8/1991 | Kern et al. | 169/61 X |

FOREIGN PATENT DOCUMENTS

| | | |
|---|---|---|
| 15199/88 | 10/1990 | (AU) . |
| 11469/95 | 1/1995 | (AU) . |

* cited by examiner

*Primary Examiner*—Andres Kashnikow
*Assistant Examiner*—Dinh Q. Nguyen
(74) *Attorney, Agent, or Firm*—Watts Hoffmann; Fisher & Heinke Co

(57) ABSTRACT

A mechanism is disclosed for the activation of a system which will deliver material such as a fire extinguishant in response to an electrical signal from a fire detector. The mechanism is actuated by a small electrical storage device which operates the system even after a fire or other event has occurred and the normal electrical supply is lost. Upon actuation, a container of pressurized carbon dioxide gas is used to pressurize a container of fire extinguishing fluid, which is then delivered by a spray mechanism to the source of the fire. A feature of the mechanism is that energy levels for initiation are very low, and all other sources of energy are self contained within the mechanism.

14 Claims, 1 Drawing Sheet

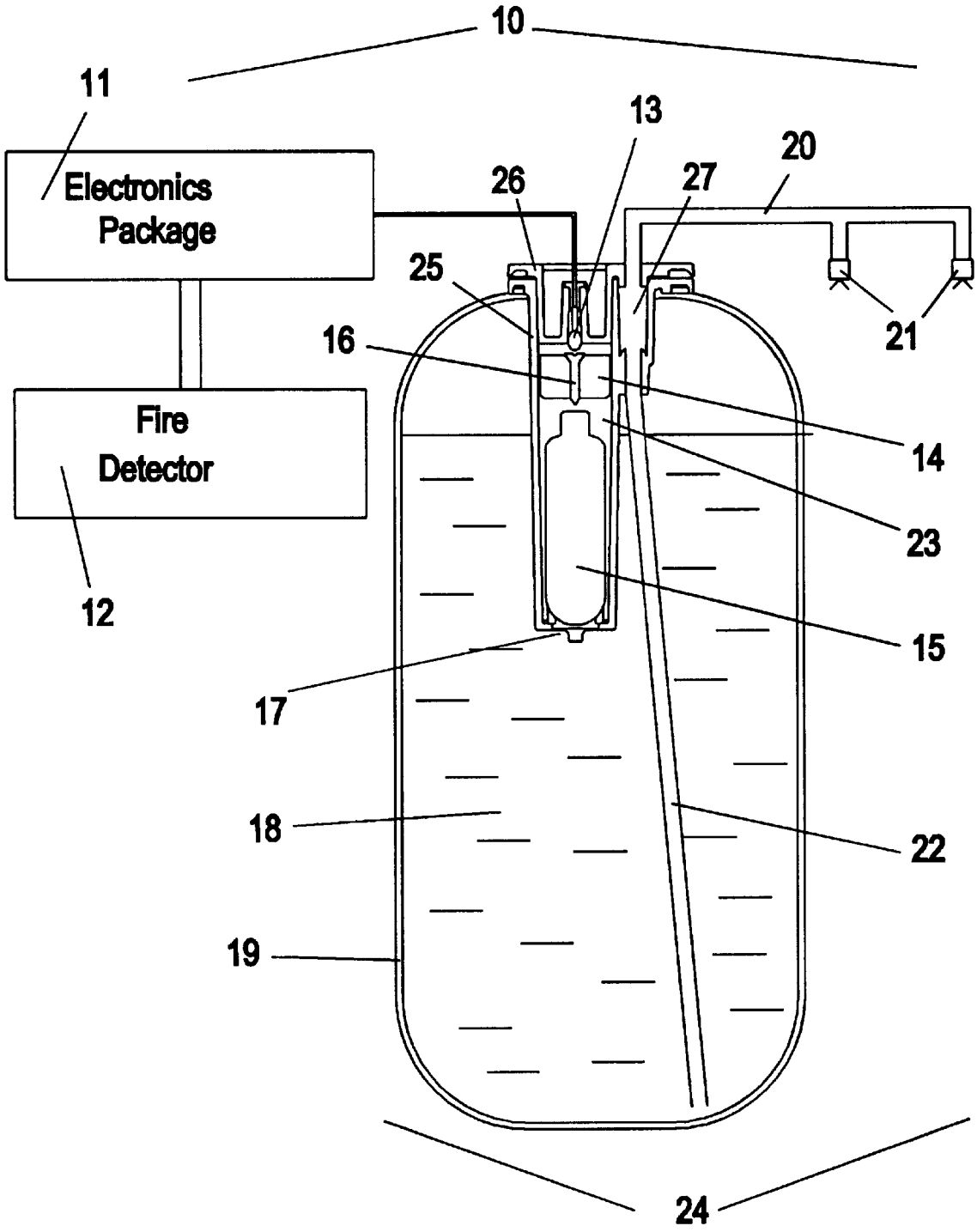
10
11
Electronics Package
Fire Detector
12
13
14
15
16
17
18
19
20
21
22
23
24
25
26
27

ACTUATING MECHANISM FOR FIRE EXTINGUISHER

FIELD OF INVENTION

This invention relates to a mechanism for actuating a device for retarding or extinguishing fires in a wide range of environments, or for actuating other devices in different situations where the delivery of a fluid is required to control an emergency situation. In particular, the present invention is highly suited for use in fire extinguishers fitted to domestic appliances, or for the protection of transport vehicles, by way of example.

BACKGROUND OF THE INVENTION

The use of plastics materials as a substitute for metals in the manufacture of housings, containers and components of machines and appliances is greatly expanding. Plastics materials are generally flammable and there is a danger of fire in such machines should ignition occur.

When plastics materials are exposed to heat or fire they can melt and/or ignite releasing toxic volatiles and exhibiting problems associated with oil based fires. Fire retardants can be added to plastics materials but the service life of those retardants is often substantially less than the service life of the plastics components. Typical fire retardants are relatively volatile and vaporise from the plastics material over time. Furthermore, if the fire is fierce, then the fire retardants can be driven from the plastics materials before the fire reaches them, rendering the fire retardants effect null.

If an appliance or machine containing plastics materials catches fire, it is important to detect the fire as early as possible in order to control and extinguish it. There are many means of detection of fire including smoke, heat, light and gas emissions. Within a machine or appliance, the choice of the means of detection of a fire will be made on the basis of early and reliable detection, and the cost of the detection means.

The most likely cause of a fire in an appliance or machine which is otherwise operating normally is by a failure in the electrical systems within the appliance or machine. Electrical failure is generally by overheating and then short circuit of electrical components which generates severe local heating and then ignition of the overheated components when the short circuit finally occurs. In many cases of such fires, the ignition by short circuit is likely to cause any fuses protecting the supply wiring to go open circuit since the short circuit generally results in a sudden increase in current. It must therefore be assumed that when fire occurs in appliances or machines that there is no power supply available to the fire detection system or the fire extinguishing system. The assumption that the appliance or machine has no power supply at the time of ignition makes early detection of the fire even more important since there is no ready source of energy available to operate the fire extinguishing system.

The factors considered above make it essential that any fire detecting and extinguishing system to be installed in an appliance or machine must have a self contained source of energy of sufficient magnitude to power the fire detection means for a period of time after the interruption of the power supply during which a fire might manifest itself. The power supply must then still have sufficient energy to activate a fire extinguishing system should a fire be detected during this time. Many such sources of energy are available such as rechargeable electric batteries and electronic capacitors. Each of these sources have limitations. Electric batteries require sophisticated charging circuits and the types presently available do not have working lives which would extend over the period of time represented by the life of most appliance or machines. Since most appliances and machines are sold into markets which there is an expectation that the appliance or machine will not require service then there is no ready means of assuring that the battery will be kept in good working order for the life of the appliance. Electronic capacitors are considerably more reliable than electric batteries and require less sophistication in keeping them charged during the operation of the appliance or machine. However, electronic capacitors can only store a small amount of energy and for a limited time compared to an electric battery.

When the preferred method of storing energy is an electronic capacitor due to its reliability and cost, then there is only a small quantity of energy available to operate a fire extinguishing device in the event of a fire. For reliable operation of the fire extinguishing device, it must be able to operate with very small quantities of electrical energy. Since the fire extinguishing device must be able to distribute substantial quantities of fire extinguishing material throughout the appliance or machine in order to be effective then it must have access to substantial quantities of energy. Such a fire extinguishing material is a water based Aqueous Film Forming Foam, a commercially available fire extinguishing material which is particularly effective at extinguishing fires in plastic based materials.

Therefore, if only very small quantities of energy available to initiate the fire extinguisher from electronic capacitors at the start of a fire and then substantial quantities of energy are required to distribute the fire extinguishing medium, then there is a requirement for a mechanism capable of amplifying or cascading the available energy sources up to the level required of the fire extinguishing material.

Even though the present invention will be primarily described in relation to fire extinguishment it will be appreciated that in its broadest form it is not limited to that specific application.

DESCRIPTION OF THE PRIOR ART

A wide variety of apparatus and methods have been developed for the detection and extinguishment of fires. However, none of these methods are applicable to situations where a fire extinguishing device is required to operate automatically without ready access to a source of electrical energy for detection of the fire and activation of the fire extinguishing device.

Patent document No. W09513115-A describes an actuator mechanism for a fire extinguisher which comprises a gas cartridge or cylinder with an elastic seal around its lower end above a striker pin. The striker pin is forced against the bottle by a trigger pushing down on a shaft, thereby piercing the bottle and releasing the gas.

This apparatus requires large forces and quantities of energy for actuation and is intended to be triggered by manual operation. The mechanism could not be actuated by the energy available from a small electrical energy storage device and has no provision for actuation by same.

U.S. Pat. No. 4,637,473 describes a Fire Suppression System designed to protect an enclosed operation such as a filter system. A detector of combustion products detects the presence of fire within the enclosure. If fire is detected, a control system shuts down the operation of the device and releases a fire extinguishing substance into the enclosure.

The mechanism and apparatus described assumes that readily procurable conventional actuators are available to shut down the device and activate the fire extinguishing system, with no regard as to the amount of energy or force needed to achieve this action. The mechanism described has the disadvantage that large amounts of energy are required for its operation compared to the current invention.

U.S. Pat. No. 2,713,391 describes a Pyrotechnic operated Fire Extinguisher. The apparatus described consists of a vessel containing a fire extinguishing material and within the vessel a pyrotechnic device separated from the fire extinguishing material by a filter medium. In operation, the pyrotechnic device is ignited by two electric squibs.

The pressure developed by ignition of the pyrotechnic device forces the fire extinguishing material from the vessel, which is then distributed to the fire. The filter medium described prevents contamination of the fire extinguishing material by the pyrotechnic ignition.

This mechanism and apparatus has the disadvantage that large quantities of pyrotechnic material are required to generate sufficient pressure to expel the fire extinguishing material with corresponding danger of explosion and the possibility of deterioration of the pyrotechnic device before it is required to operate. The filter medium is required to avoid the problems of contamination and blockage of the fire extinguishing material. The current invention has none of these disadvantages, since pressurization of the fire extinguishing material is achieved by using a pressurised gas cylinder which is readily available, reliable and presents no contamination problems.

Australian Patent AU-A-11469/95 describes a mechanism for the control and suppression of explosions within enclosed equipment. The apparatus consists of a means of detection of an explosion which communicates a signal to a control system. The control system then ignites a pyrotechnical mixture near a gas generating cartridge, the pressure of which destroys a foil sealing the gas generating cartridge thereby igniting the gas generating cartridge. The gas so released propels a flame smothering agent into the enclosed space thereby suppressing the explosion and fire.

This apparatus and mechanism has the disadvantage that it requires the successful ignition of a gas generating device with the inherent danger of failure to ignite or explosion of the device. The current invention does not have this disadvantage. Pressurisation of the fire extinguishing material is achieved by using a pressurised gas cylinder which is readily available and reliable.

U.S. Pat. No. 4,760,886 describes a Fast Discharge Fire Extinguisher consisting of a chamber containing an inhibiting liquid which vaporises when expanded, and a pressurising gas such as nitrogen. A cover closes the container. When activated, explosive charge tears the cover by shock wave thereby releasing the pressurised contents of the chamber.

This apparatus has the disadvantage that it must be continually pressurised and therefore requires periodic service to ensure that it will be in good working condition should it ever be required to operate. The requirement for continual pressurisation greatly increases the strength required of the chamber and therefore its cost. The current invention does not have these disadvantages. The container of the fire extinguishing material is only required to be pressurised for a short period of time after actuation of the fire extinguisher. The source of pressurising gas is a sealed container of gas known for its reliability and ease of operation when required.

SUMMARY OF INVENTION AND OBJECT

It is an object of the present invention to provide an actuating mechanism for actuating a device for delivering material such as fire retardant to a desired location in which the problems of the prior art detailed above are at least ameliorated.

The invention provides a mechanism for actuating a device for delivering material such as fire retardant, to a desired location, including a container of said material, a container of pressurised fluid associated with said container of said material, and electrically operated means for releasing the pressurised fluid from its container into said container of said material to cause delivery of said material to said desired location.

By using an electrically operated means for releasing the pressurised fluid from its container, the actuating mechanism is able to be actuated by a small electrical energy storage device capable of operation even after a fire or other event has occurred.

The container of pressurised fluid can be a small bulb of carbon dioxide gas and the electrically operated releasing means can comprise means for causing a piercing means to penetrate the diaphragm of the bulb to release the pressurised fluid.

The piercing means can be carried by a piston which is driven by the electrical actuation of a detonator which generates high pressure gas to drive the piston and cause the piercing means to penetrate the diaphragm.

BRIEF DESCRIPTION OF THE DRAWINGS

The present invention will now be described by way of example with reference to the accompanying drawing which shows a schematic of one embodiment of the present invention.

DESCRIPTION OF THE PREFERRED EMBODIMENT

In the drawing, fire extinguishing system 10, associated with a powered appliance or machine, comprises an electronics package 11 including a power supply, which supplies power to a fire detector 12, which may be a smoke, gas, or other means of early detection of fire. The electronics package 11 includes an electronic capacitor or similar electrical energy storage device (not shown) with sufficient capacity to supply the fire detector 12 for a period in which a fire would become apparent after the loss of the power supply, and activate the fire extinguisher 13 shown.

The fire extinguisher 24 includes a reservoir 19 containing fire extinguishant 15. The reservoir 19 supports a closed housing 25 which sealingly engages the upper end of the reservoir 19. The housing 25 supports a container or canister 15 of pressurised gas, such as a known bulb of carbon dioxide having a puncturable diaphragm at its upper end. Above the canister 15, the housing supports a piston 14 which carries a sharp spike 16 having its sharpened end directed towards the diaphragm 17 of the canister 15. Above the piston 14, the housing 25 carries a holder 26 which sealingly engages the upper end of the housing 25 and supports a known matchhead detonator 13 of the type employed in pyrotechnic devices. The detonator 13 is connected to the electronics package 11 to actuate the detonator 13 to generate high pressure gas in the space between the holder 26 and the piston 14.

An activating signal from the electronics package 11 to the detonator 13 is generated when the fire detector 12 generates a detection signal output upon detection of a fire, smoke or the like. The high pressure gas generated by the detonator 13 drives the piston 14 along the housing 25 until the spike 16 penetrates the diaphragm of the canister 15 to release the carbon dioxide gas in the caster 15. The pressurised gas is released into the interior 23 of the housing 25 which has a weakened lower end 17 which ruptures under the pressure of the gas and releases the gas into the fire extinguisher reservoir 19. The fire extinguishant 18 within the reservoir 19 is driven from the reservoir 19 through an outlet passage 22 to a distribution means 20 connected to the holder 27 and terminating in spray heads 21 or the like positioned at the desired location.

A typical fire extinguishant 18 for use in the embodiment shown in the drawing comprises a mixture of 2 liters of water and 150 ml of AFFF, a foaming fire extinguishing agent. Canister 15 in one embodiment comprises a sparklet bulb containing 8 grams of $CO_2$ while detonator 13 is a matchhead detonator.

One suitable detonator is model SA 2000 AN 289BR manufactured by Daveyfire Inc, USA.

Reservoir 19 can be a 2 liter container capable of withstanding a pressure of about 1 MegaPascal for a short period of time until all of the extinguishant 18 is sprayed onto the fire in the appliance or machine.

Fire detector 12 is preferably gain adjustable to avoid false alarms but with gain being set to a level to be balanced with the need for early detection of the fire.

One suitable detonator is a smoke detector model 83RIB-AUS manufactured by BRK Brands Inc, USA, which has the feature of having an output line which goes high when smoke is detected.

As can be seen in the depicted embodiment there is very low power consumption and low energy needs to activate an extinguishing device. Desirably, the electronics package 11 includes a power supply with the facility to store sufficient energy to detect fire and activate the fire extinguisher up to, say, 30 minutes after power is turned off from the appliance. One suitable electronics package is described in Australian Provisional Patent Application No PP 1999 dated 24 Feb., 1998, the contents of which are incorporated into the present specification by cross reference.

A range of environments in which the present invention could be employed include automotive bays; fire at risk compartments in boats; unattended storage facilities; paint or chemical stores; battery charging facilities or fixed domestic or industrial appliances.

The use of an explosive device, such as detonator 13, to release a large store of energy in a pressurised gas cylinder has wider application than solely for the purpose of fire extinguishment. Such means could be used in association with the detection of emergency conditions in drives, bearings or the like with actuation of a power shut down or the application of lubrication. In another environment such means could be employed for on-line inflation of vehicle types to enable a safe stopping procedure.

While the use of an explosive device, such as detonator 13, has advantages, it will be appreciated that other means for driving the support 14 for the spike 16 can be used, such as solenoid devices. It will also be appreciated that the gas canister 15 can be driven into a fixed spike to release the gas in the canister. In this case, a piston or solenoid device engages the canister and drives it within the housing to engage the spike. Such an arrangement is described more fully in Australian Provisional Patent Application No PO 9068 dated 9 Sep. 1997, the contents of which are incorporated into the present specification by cross-reference.

A mechanism 10 for actuating a device 24 for delivering material 18, such as fire retardant, lubricant or the like, to a desired location, including a container 19 of the material 18, a canister 15 of pressurised gas having a diaphragm arranged within a housing 15, a piston 14 carrying a spike 16 within the housing 25 and an explosive device 13 within the housing 25 for driving the piston 14 to rupture the diaphragm and release the gas from the canister 15 to deliver the material to a desired location.

It will appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

What I claim is:

1. A mechanism for actuating a device to deliver material to a material distributor, said mechanism comprising:

an electrically operable explosive device;

an electronic capacitive electrical source operably connected to the explosive device for energizing the explosive device to cause explosive emission of a pressure pulse;

structure defining a first chamber containing said explosive device;

the structure including a movable wall portion actuateable by a pressure pulse generated by said explosive device;

a diaphragm piercer;

a container of nonflammable pressurized fluid having a rupturable diaphragm adapted to be pierced by said diaphragm piercer in response to movement of the movable wall portion;

the structure defining a second chamber around said container and a third chamber for containing such material the second chamber being for receipt of the pressurized fluid from said container when the diaphragm is penetrated;

a pressure responsive release device for communicating pressurized fluid from said second chamber with the third chamber; and the structure further defining an outlet passage connected to the interior of said third chamber for feeding pressurized material to the distributor.

2. The mechanism of claim 1, wherein said moveable wall portion is formed as a piston.

3. The mechanism of claim 2, wherein the explosive device comprises a pyrotechnic detonator.

4. The mechanism of claim 1, wherein said moveable wall portion is formed as a piston.

5. The mechanism of claim 4, wherein the movable wall portion carries said diaphragm piercer.

6. The mechanism of claim 1, wherein the movable wall portion carries said diaphragm piercer.

7. The mechanism of claim 1, wherein said container of pressurized fluid comprises a replaceable canister of pressurized gas.

8. The mechanism of claim 1, wherein said material is a selected one of a fire retardant, a fire extinguishant, a lubricating material, and a gas.

9. The mechanism of claim 1, in which the said pressure responsive release device is a rupturable diaphragm.

10. The mechanism of claim 1, further including an event detector for activating said electrical source upon the occurrence of a predetermined event.

11. A fire extinguishing system comprising:

a) a reservoir having an internal space containing a supply of fire extinguishment material;

b) a housing carried by the reservoir and projecting into the space;

c) a canister of pressurized gas carried by the housing and positioned to discharge the pressurized gas into the space;

d) an electrically actuatable piercing mechanism carried by the housing and positioned to pierce a canister seal and release said pressurized gas upon receipt of a low energy electric pulse;

e) an electronics package including an electrical supply component adapted to emit a low energy electric pulse and a conductor operably connected to the supply component and the piercing mechanism for transmitting such an electrical pulse to the piercing mechanism;

f) a fire detector operably connected to the package for sensing the existence of a fire and emitting a signal, the supply component being adapted to emit such a pulse in response to such a signal; and, g) a material delivering mechanism connected to the reservoir and projecting into the space for transmitting the material to a fire as the material is forced through the delivery mechanism by the pressurized gas upon release of the gas from the canister.

12. The system of claim 11 wherein the supply mechanism is a capacitor.

13. The system of claim 11 wherein the piercing mechanism includes a piston driven piercer.

14. The system of claim 11 wherein the material is a selected one of a fire retardant and a lubricant.

* * * * *